US005898117A

United States Patent [19]

Ishida

[11] Patent Number: 5,898,117

[45] Date of Patent: Apr. 27, 1999

[54] ANTIBACTERIAL KEYBOARD

[75] Inventor: Muneo Ishida, Hamamatsu, Japan

[73] Assignee: Kabushiki Kaisha Kawai Gakki Seisakusho, Shizuoka-Ken, Japan

[21] Appl. No.: 08/765,382

[22] PCT Filed: Apr. 25, 1996

[86] PCT No.: PCT/JP96/01159

§ 371 Date: Dec. 19, 1996

§ 102(e) Date: Dec. 19, 1996

[87] PCT Pub. No.: WO96/35205

PCT Pub. Date: Nov. 7, 1996

[30] Foreign Application Priority Data

May 1, 1995 [JP] Japan ..... 7-107374

[51] Int. Cl.[6] ..... G10C 3/12

[52] U.S. Cl. ..... 84/423 R; 424/404; 424/405

[58] Field of Search ..... 424/404, 405; 84/423 R

[56] References Cited

FOREIGN PATENT DOCUMENTS

| | | |
|---|---|---|
| 63-86752 | 4/1988 | Japan . |
| 63-213892 | 9/1988 | Japan . |
| 9046055 | 7/1995 | Japan . |

*Primary Examiner*—William M. Shoop, Jr.
*Assistant Examiner*—Kim Lockett
*Attorney, Agent, or Firm*—Davis and Bujold

[57] ABSTRACT

An object is to provide an antibacterial keyboard which keeps to be clean and can be prevented from being discolored by growing or grown bacteria. Methyl methacrylate resin as acrylic resin, and a ceramic body as an antibacterial agent prepared by mixing and sintering calcium phosphate and silver metal are used: 0.5% to 2% by weight of the ceramic body prepared by mixing and sintering calcium phosphate and silver metal is blended and uniformly dispersed in the methyl methacrylate resin. The blend is injection molded, to form piano natural key coverings. The piano natural keys covered with such coverings are superior in an antibacterial, keep to be clean and can be prevented from being discolored by growing or grown bacteria.

6 Claims, 3 Drawing Sheets

ANTIBACTERIAL KEYBOARD

TECHNICAL FIELD

The invention relates to an antibacterial keyboard.

BACKGROUND OF THE INVENTION

Conventionally, a piano, an accordion, an organ, an electronic instrument or other keyboard instrument is efficiently manufactured by injection molding acrylic resin or other synthetic resin.

The keyboard instrument is, however, played by a relatively large number of people when it is installed, for example, at school, and bacteria are conveyed from person to person via fingers and thumb. Recently, people increasingly had a liking for cleanliness. Therefore, keyboard instruments have also been demanded to be always clean.

People not only play the keyboard instrument but also own it as a piece of interior decoration. Therefore, the keyboard instrument is demanded to be firmly prevented from being discolored by grown bacterial.

DISCLOSURE OF THE INVENTION

The invention has been developed to solve the aforementioned problem, and an object of the present invention is to provide an antibacterial keyboard which is kept clean and can be prevented from being discolored because of the propagation of bacteria.

To attain this and other objects, the present invention provides an antibacterial keyboard molded of synthetic resin with antibacterial agent mixed therein. The propagation of bacteria is inhibited by the antibacterial agent on the antibacterial keyboard.

The aforementioned antibacterial agent preferably contains at least one metal selected from the group consisting silver, copper and zinc (these metals are provided with antibacterial activity), and especially preferably contains silver metal. Silver metal is for use in dental products and tableware, because it is highly safe for human body. Calcium phosphate is a desirable carrier of silver metal, because it is also highly safe for human body and is allowed to be included in food additives and cosmetics.

The synthetic resin preferably contains 0.5% to 2% by weight of the aforementioned antibacterial agent. If the content of the antibacterial agent is less than the lower limit, insufficient antibacterial effect is provided. Even if the content of the antibacterial agent exceeds the upper limit, the antibacterial effect can be increased no more. The synthetic resin containing an excess quantity of the antibacterial agent is expensive, and is insufficiently rigid to be molded into the keyboard.

The antibacterial agent for use in the present invention is preferably composed of a calcium phosphate carrying a silver metal. The antibacterial agent is prepared, for example, by sintering the mixture of calcium phosphate and silver compound at 1000° C. or higher temperature. Through the sintering process, silver ion in the silver compound is all converted to silver metal. By sintering calcium phosphate and silver metal, an antibacterial ceramic results. When such ceramic, processed at high temperatures, is blended in the synthetic resin to be injection molded into the keyboard, the decomposition, discoloration, and properties change of the final product or the keyboard can be avoided. The keyboard is also prevented from being yellowed because of the eluation of silver ion. The antibacterial ceramic is neither eluted nor volatized, and can maintain its antibacterial activity over a long use. The silver compound for use in the sintering process is not restricted to a specific compound, when it can be transformed to silver metal through the sintering process. Any carrier other than calcium phosphate can be used, when it has superior stability.

The antibacterial keyboard according to the invention is protected from the propagation of bacteria by the antibacterial agent blended in the synthetic resin, and can be kept clean. The antibacterial agent controls the bacterial propagation, and can prevent the keyboard from being blackened, wetted or discolored. Especially, when the antibacterial agent contains silver metal, the keyboard is protected from the discoloration and, additionally, the antibacterial agent itself can be prevented from being discolored with time. Therefore, the piano provided with the antibacterial keyboard can advantageously maintain its beautiful appearance. When the antibacterial agent is the ceramic prepared by mixing and sintering silver metal and calcium phosphate, it provides high safety, in addition to the aforementioned advantages.

BEST MODES FOR PRACTICING THE INVENTION

Figure 1:
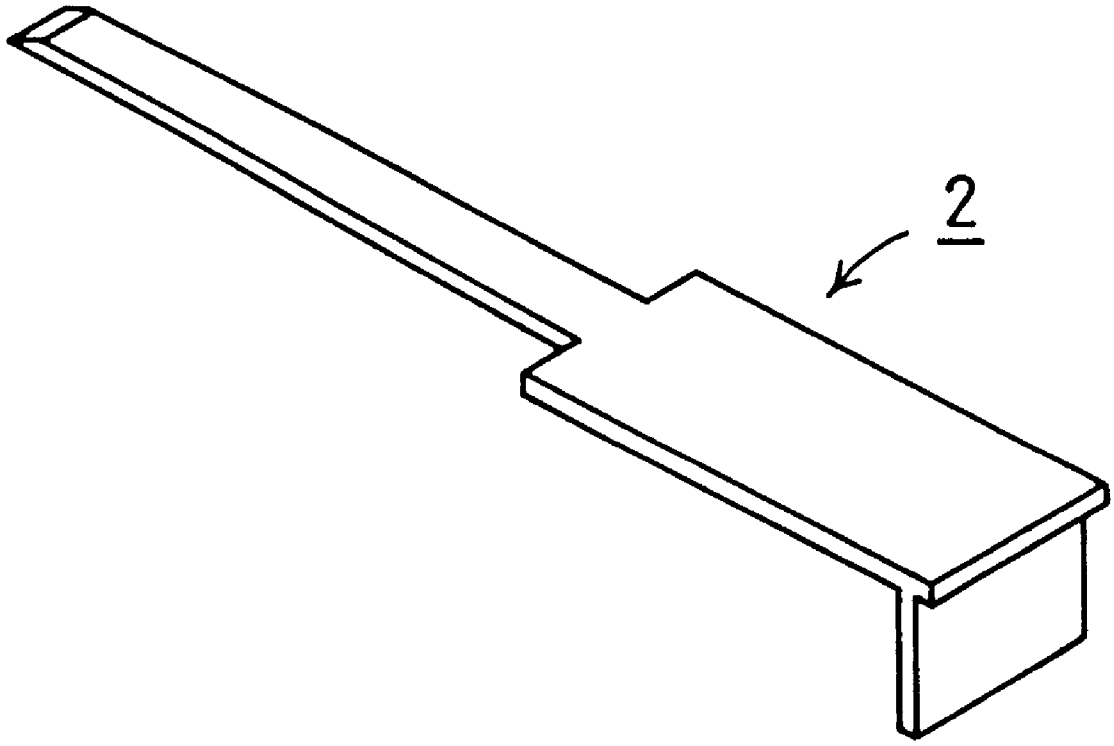
FIG. 1 is a perspective view of a piano natural key covering.

Preferred embodiments of the present invention are now explained. FIG. 1 is a perspective view of a piano natural key covering, and FIG. 2 is a perspective view of a piano natural key

[Embodiment 1]

A pellet of methyl methacrylate resin was used as acrylic resin, Apacider A (manufactured by Sangi Kabushiki Kaisha) was used as an antibacterial agent, and Apacider A was blended in the range from 0.5% to 2% by weight, and uniformly dispersed in methyl methacrylate resin. The pellet was injection molded to form a piano natural key covering 2 shown in FIG. 1.

Figure 2:
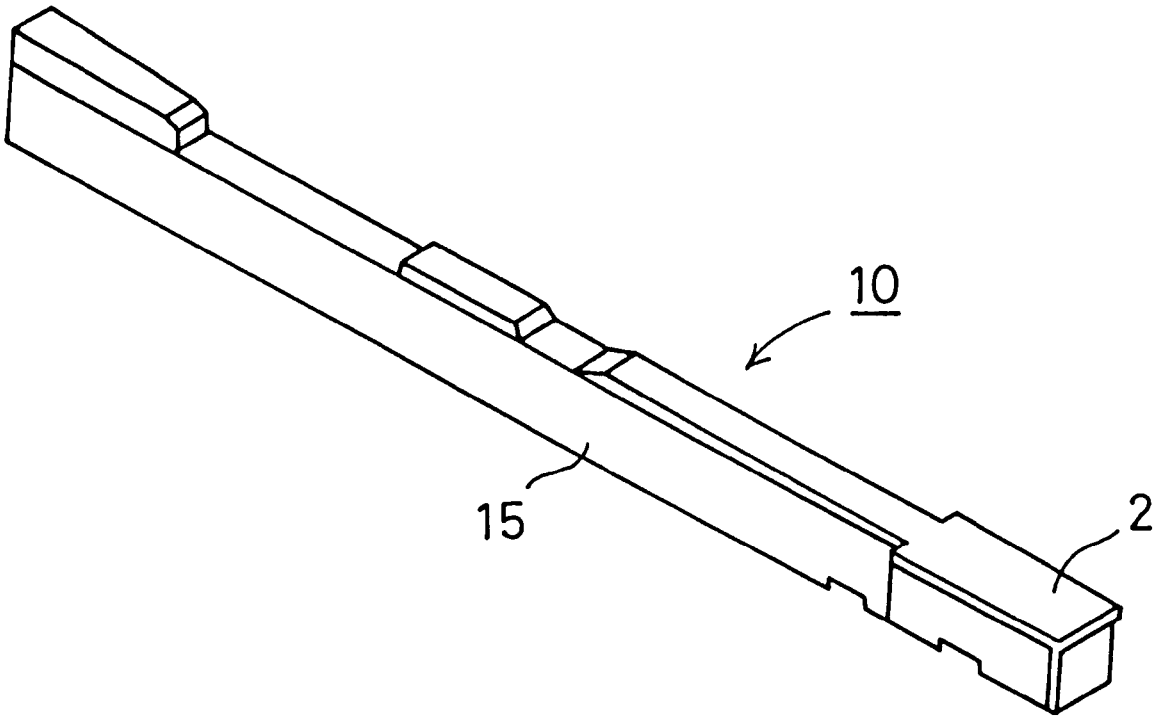
FIG. 2 is a perspective view of a piano natural key.

The piano natural key covering 2 is adhered to the front part of a key plate 4, forming a piano natural key 10, as shown in FIG. 2.

In the aforementioned Apacider A, silver metal is carried by calcium phosphate (hydroxyapatite or tricalcium phosphate). The mixture of calcium phosphate and silver compound is sintered at 1000° C. or higher temperature, and silver ion in the silver compound is all converted to silver metal during the sintering process. It was confirmed by detecting no silver ion is eluted in water through atomic-absorption spectroscopy (with analysis limit of 0.05 ppm), that all the silver ions were changed to silver metals. Such Apacider A is the ceramic obtained by sintering calcium phosphate and silver metal, and is highly safe for human body and environment.

[Embodiment 2]

In the second embodiment, 27 parts by weight of phthalate ester plasticizer, 0.2 parts by weight of epoxy compound and 0.3 parts by weight of alkyl phosphite as thermal stabilizers, 30 parts by weight of silica having 2.1 silanol groups per 100 square angstrom, a BET specific surface area of 136 $m^2/g$ and an average particle diameter of 0.9 $\mu$m, and 2.5 parts by weight of white pigment were added to 100 parts by weight of cellulose acetate flake. These materials were stirred and mixed using a universal agitator at 80° C. for 4 hours, and were dried until the water content was reduced to 0.2% by weight or less. The mixture was melted, kneaded at 220° C. extruded, and pelletized, using an extruder and a die having an inner diameter of 40 mm.

Subsequently, 0.5% to 2% by weight of Apacider A was blended and uniformly dispersed in the pellet, and injection molded in the same manner as in the first embodiment, thereby forming the piano natural key covering 2.

[Reference Example]

Methyl methacrylate resin was used as the acrylic resin, and was injection molded to form the piano natural key covering 2.

[Experimental Results]

The piano natural key coverings of the first and second embodiments and the reference example were checked for changes in antibacterial activity and in color with time. As a result, the piano natural key coverings of the first and second embodiments were kept clean with only little bacteria growing thereon, and were prevented from being blackened or wetted by the bacterial propagation. The antibacterial agent itself was also prevented from being discolored with time. The piano natural key coverings remained white for a long time. On the other hand, the piano natural key covering of the reference example was subject to the bacterial propagation, and was blackened, wetted and discolored.

When copper metal or zinc metal is blended to the antibacterial agent, instead of silver metal, the effects almost identical to those resulting from the embodiments were provided. However, the antibacterial agent including silver metal most advantageously prevents the natural key covering from being discolored.

This invention is not limited to the preferred embodiments, and is intended to include all such modifications and alterations within the spirit and scope of the appended claims.

Figure 3:
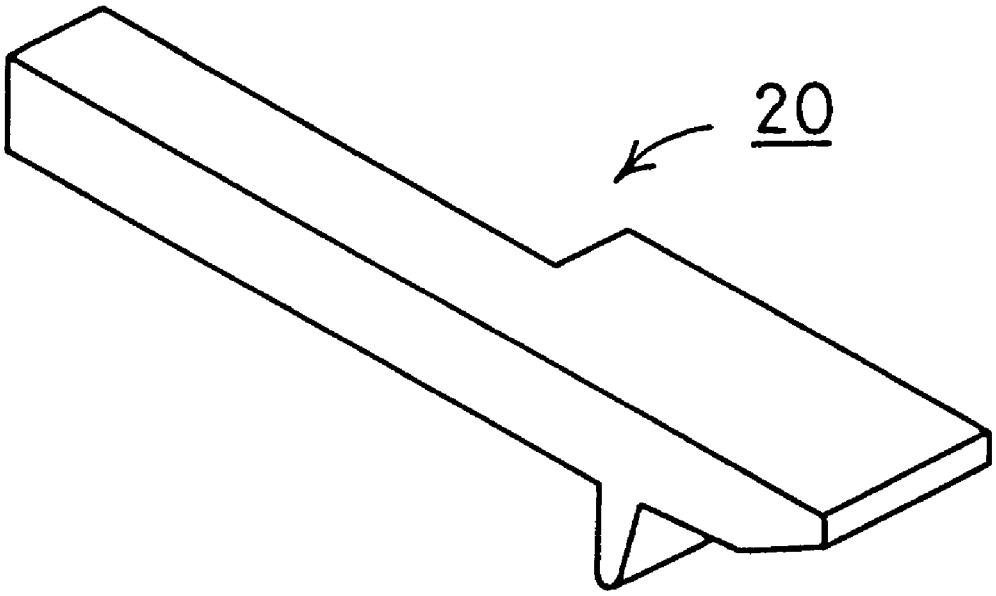
FIG. 3 is a perspective view of an organ natural key.

For example, in the embodiments, the piano natural key coverings were explained. The antibacterial keyboard according to the present invention can be, however, applied to an accordion, an organ, an electronic instrument or other keyboard instrument. A perspective view of an organ natural key 20 is shown in FIG. 3.

According to the present invention, sharp keys can also be made antibacterial.

What is claimed is:

1. An antibacterial keyboard molded from synthetic resin with antibacterial agent blended therewith.

2. An antibacterial keyboard according to claim 1 wherein said antibacterial agent contains at least one metal selected from the group consisting of silver, copper and zinc.

3. An antibacterial keyboard according to claim 1 wherein said antibacterial agent is a ceramic prepared by mixing and sintering silver metal and calcium phosphate.

4. An antibacterial keyboard according to claim 1 wherein 0.5% to 2% by weight of said antibacterial agent is blended in synthetic resin.

5. An antibacterial keyboard according to claim 2 wherein 0.5% to 2% by weight of said antibacterial agent is blended in the synthetic resin.

6. An antibacterial keyboard according to claim 3 wherein 0.5% to 2% by weight of said antibacterial agent is blended in the synthetic resin.

* * * * *